US007171826B1

(12) United States Patent
Antonyan

(10) Patent No.: US 7,171,826 B1
(45) Date of Patent: Feb. 6, 2007

(54) EARRING POST COVERING

(76) Inventor: Ilona Antonyan, 8484 Lake Ben Ave., San Diego, CA (US) 92119

( * ) Notice: Subject to any disclaimer, the term of this patent is extended or adjusted under 35 U.S.C. 154(b) by 56 days.

(21) Appl. No.: 10/922,841

(22) Filed: Aug. 23, 2004

(51) Int. Cl.
*A44C 7/00* (2006.01)

(52) U.S. Cl. ..... 63/12; 63/40; 24/705

(58) Field of Classification Search ..... 63/12, 63/13, 33; 24/705, 706.6, 706.9, 707.2, 707.5, 24/707.6; 606/184, 185, 186, 188
See application file for complete search history.

(56) References Cited

U.S. PATENT DOCUMENTS

| | | | | | |
|---|---|---|---|---|---|
| 3,504,507 | A | * | 4/1970 | Ferro | 63/12 |
| 4,067,341 | A | | 1/1978 | Ivey | |
| 4,089,189 | A | | 5/1978 | Verducci | |
| 4,593,540 | A | | 6/1986 | Cuvar et al. | |
| 4,723,421 | A | * | 2/1988 | Nitsche | 63/12 |
| 4,771,613 | A | * | 9/1988 | Grier et al. | 63/12 |
| 4,829,788 | A | | 5/1989 | DiDomenico | |
| 5,018,365 | A | * | 5/1991 | Luceno | 63/12 |
| 5,020,338 | A | | 6/1991 | Payne et al. | |
| 5,076,072 | A | * | 12/1991 | Payne | 63/12 |
| 5,154,068 | A | * | 10/1992 | DiDomenico | 63/12 |
| 5,392,617 | A | | 2/1995 | Baldwin | |
| 5,411,516 | A | * | 5/1995 | Thomas | 63/12 |
| 5,454,829 | A | * | 10/1995 | Koland | 63/12 |
| 5,456,094 | A | | 10/1995 | Greenwald | |
| 5,632,163 | A | * | 5/1997 | Inoue | 63/12 |
| 5,743,113 | A | * | 4/1998 | Kogen | 63/12 |
| 5,855,587 | A | * | 1/1999 | Hyon et al. | 606/188 |
| 5,893,277 | A | * | 4/1999 | Biagi | 63/12 |
| 6,105,392 | A | * | 8/2000 | Biagi | 63/12 |

FOREIGN PATENT DOCUMENTS

| | | | | |
|---|---|---|---|---|
| FR | 2 581 520 A1 | * | 11/1986 | 63/12 |
| GB | 2 239 781 A | * | 7/1991 | 63/12 |
| GB | 2 244 636 A | * | 12/1991 | 63/12 |
| GB | 2 249 252 A | * | 12/1992 | 63/12 |
| JP | 406292607 A | * | 10/1994 | 63/12 |
| WO | WO 92/21262 | * | 12/1992 | 63/12 |

* cited by examiner

*Primary Examiner*—Robert J. Sandy
*Assistant Examiner*—Ruth C. Rodriguez

(57) ABSTRACT

An earring post covering for preventing allergic reaction to earring posts includes an elongated member that has a first end, a second end and a peripheral wall extending between the first and second ends. The elongated member has an aperture extending into the first end such that a tube is defined. The second end is closed and has a rounded outer surface. A plurality of teeth is attached to an interior surface of the peripheral wall. Each of the teeth comprises a resiliently compressible material. An earring post may be removably extended through the elongated member such that the teeth grip the post.

12 Claims, 2 Drawing Sheets

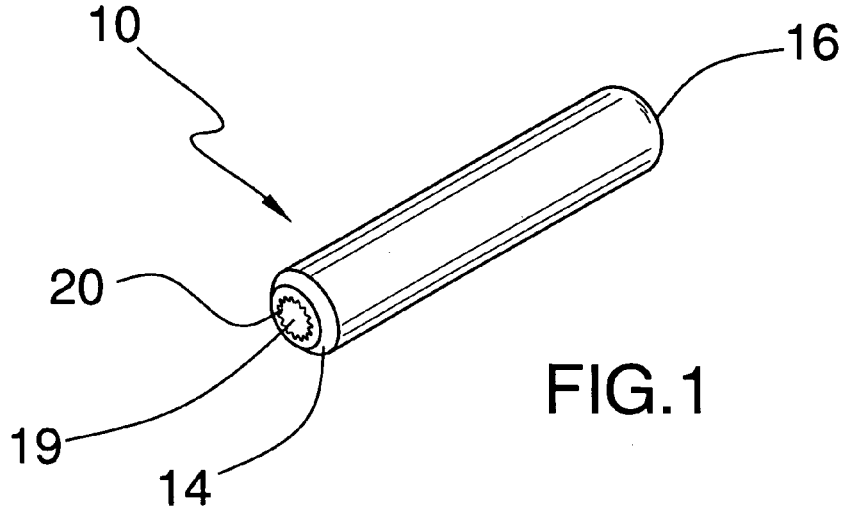
FIG.1
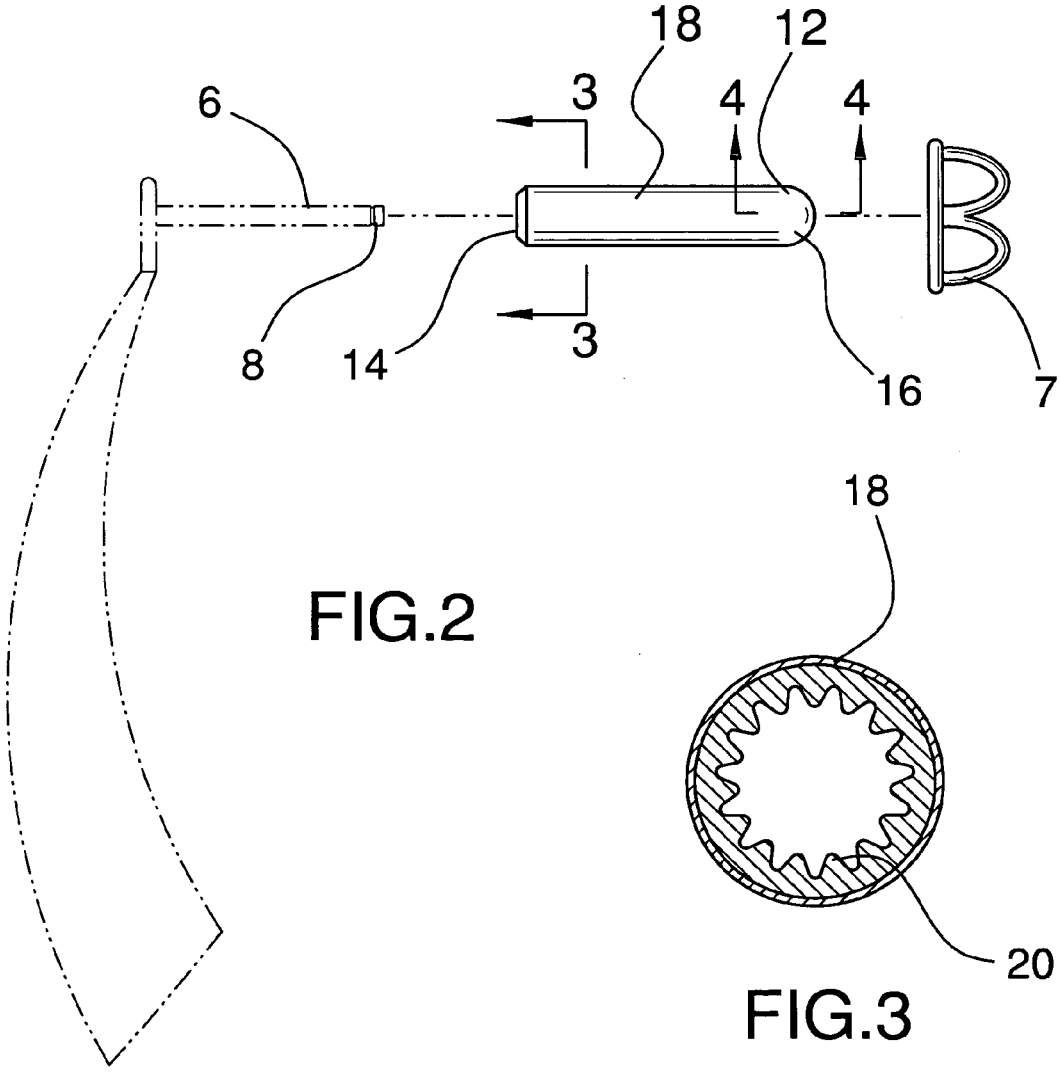
FIG.2
FIG.3

EARRING POST COVERING

BACKGROUND OF THE INVENTION

1. Field of the Invention

The present invention relates to earring post covering devices and more particularly pertains to a new earring post covering device for protecting an ear from the metal of an earring post.

2. Description of the Prior Art

The use of earring posts for persons suffering from allergies to metals is known in the prior art. U.S. Pat. No. 5,392,612 describes a sleeve made of inert materials used for an earring post. Another is found in U.S. Pat. No. 4,089,189 which is constructed of inert materials to prevent allergic reactions.

While these devices fulfill their respective, particular objectives and requirements, the need remains for a device that allows a person to wear all types of earrings, and particularly antique and handmade pieces, without concern of the type of the metal from which the post is constructed.

SUMMARY OF THE INVENTION

The present invention meets the needs presented above by utilizing a sleeve which receives the posts of conventional earrings and covers the post so that a barrier is formed between the post and ear. This device is easily retrofitted to existing earrings having conventional posts.

Another object of the present invention is to provide a new earring post covering device that includes teeth within the covering for gripping the post. This ensures that the covering does not move along the post.

To this end, the present invention generally comprises an elongated member that has a first end, a second end and a peripheral wall extending between the first and second ends. The elongated member has an aperture extending into the first end such that a tube is defined. The second end is closed and has a rounded outer surface. A plurality of teeth is attached to an interior surface of the peripheral wall. Each of the teeth comprises a resiliently compressible material. An earring post may be removably extended through the elongated member such that the teeth grip the post.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of an earring post covering according to the present invention.

FIG. 2 is a side view of the present invention.

FIG. 3 is a cross-sectional view taken along line 3—3 of FIG. 2 of the present invention.

DESCRIPTION OF THE PREFERRED EMBODIMENT

Figure 4:
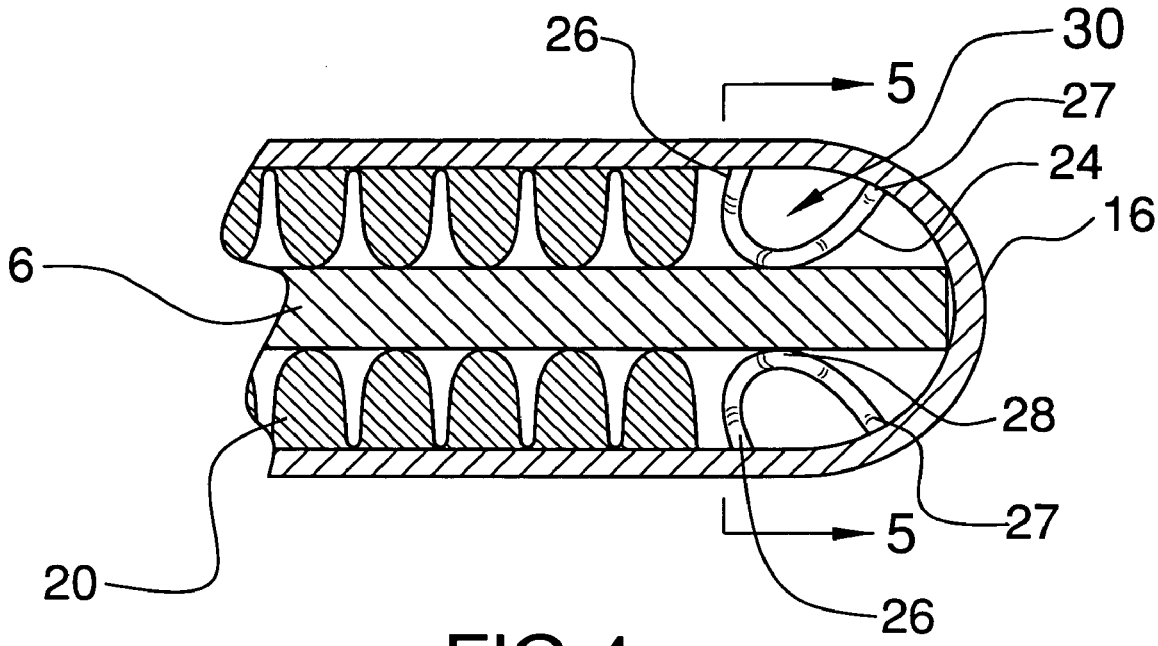
FIG. 4 is a cross-sectional view taken along line 4—4 of FIG. 2 of the present invention.

With reference now to the drawings, and in particular to FIGS. 1 through 5 thereof, a new earring post covering device embodying the principles and concepts of the present invention and generally designated by the reference numeral 10 will be described.

As best illustrated in FIGS. 1 through 5, the earring post covering 10 generally comprises a device for removably positioning over a post 6 of an earring before the post 6 is extended through an earring hole in an ear. The covering 10 includes an elongated member 12 having a first end 14, a second end 16 and a peripheral wall 18 extending between the first 14 and second 16 ends. The elongated member 12 has an aperture 19 extending into the first end such that a tube is defined wherein the second end 16 is closed. The elongated member 12 comprises a hypoallergenic material. Some examples of these include gold and steel alloys, plastic materials or elastomers. Plastic materials and elastomers may be utilized for positioning on a post 6 which is curved so that the elongated member 12 may bend with the post 6. The elongated member 12 has a length from the first end 14 to the second end 16 less than ½ inch and a diameter less than ¼ inch. It is preferred that the second end 16 is rounded and has a convex shape.

A plurality of teeth 20 is attached to an interior surface of the peripheral wall. The teeth 20 extend from the first end 14 and toward the second end 16 of the elongated member 12. Each of the teeth 20 comprises a resiliently compressible material. The resiliently compressible material is preferably a plastic or an elastomer. A foamed elastomer may also be utilized which is impregnated with magnetically charged metallic filaments so that the teeth 20 are magnetically attracted to the metal of the post 6.

Figure 5:
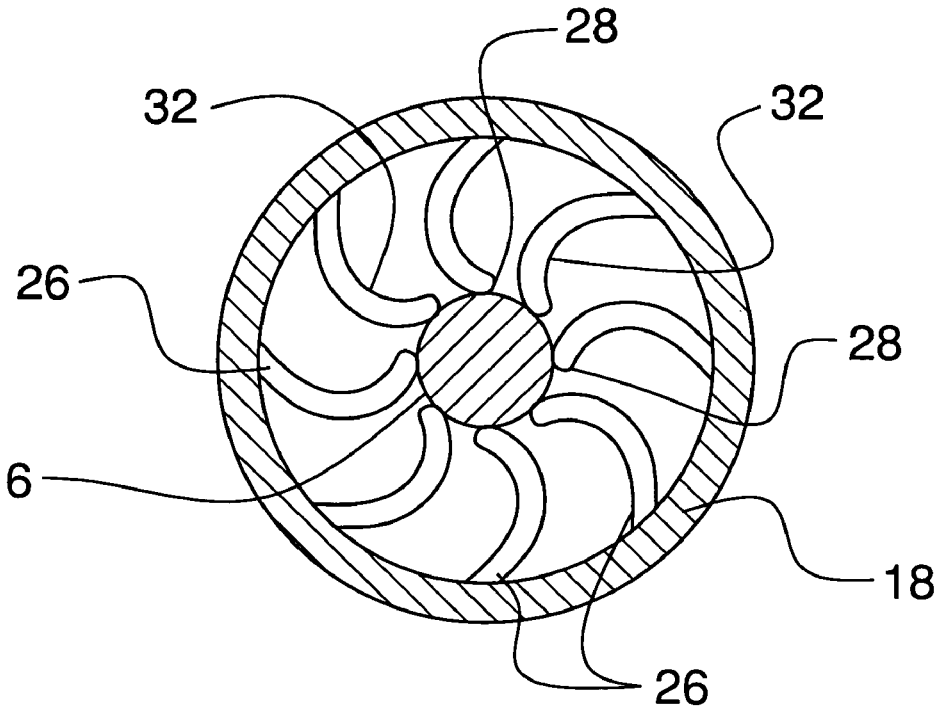
FIG. 5 is a cross-sectional view taken along line 5—5 of FIG. 4 of the present invention.

A plurality of gripping fingers 24 each includes an arced rod that has a pair of attached ends 26, 27 and a central portion 28. The attached ends 26, 27 are each attached to the interior surface of the peripheral wall 18 so that a loop 30 is defined. As is shown in FIG. 4, each of the attached ends 26, 27 is positioned along a line that is orientated parallel to a longitudinal axis of the elongated member 12. The gripping fingers 24 are each positioned generally adjacent to the second end 16 of the elongated member 12. Preferably, as shown in FIG. 5, each of the loops 30 is non-planar and has a curve 32 therein such that each of the loops 30 is curved with respect to a plane that is co-planar with the longitudinal axis. The non-planar nature of the loops 30 causes the loops 30 to extend toward and then away from longitudinal axis of the elongated member 12. This places an opening between the central portions 28 for receiving the post 6. Each of said gripping fingers 24 are positioned generally adjacent to each other. The plurality of gripping fingers 24 preferably includes between four and eight gripping fingers 24 that are each comprised of a resiliently flexible material.

In use, a person who is going to wear an earring may removably extend the post 6 of the earring into the elongated member 12 such that the teeth 20 grip the post. The central portions 28 abut and frictionally engage the post 6 as the post 6 is passed between them and abutted against an inner surface of the second end 16. The post 6 and covering 10 are then extended through an ear. The rounded second end 16 of the elongated member 12 allows the covering 10 to easily pass into and through the earring hole of an ear. Once extended through the ear, the post 6 and its associated covering 10 may be secured with a male clasp 7 conventionally used with earring posts, however, the clasp 7 is of a larger size to accommodate the reception of the elongated member 12. The clasp 7 is likewise constructed of a hypoallergenic material. The covering 10 acts a barrier between the metal of the post 6 and the skin of the ear to prevent infections, irritation and itching caused by allergic reactions and oxidation of the metal in the post 6.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An earring device being extended through an earring hole in an ear, said device comprising:

an earring post being extendable though the earring hole;

an elongated member having a first end, a second end and a peripheral wall extending between said first and second ends, said elongated member having an aperture extending into said first end such that a tube is defined, said second end being closed and having a rounded outer surface;

a plurality of teeth being attached to an interior surface of said peripheral wall, each of said teeth comprising a resiliently compressible material, said post being extended through said elongated member and said teeth gripping said post, and then said elongated member and said post each being extended into the earring hole.

2. The device according to claim 1, wherein said elongated member has a length from said first end to said second end less than ½ inch.

3. The device according to claim 2, wherein said elongated member has a diameter less than ¼ inch.

4. The device according to claim 1, wherein said teeth extending from said first end of said elongated member and toward said second end of said elongated member.

5. The device according to claim 4, wherein said teeth are magnetic.

6. The device according to claim 4, further including a plurality of gripping fingers being mounted in said elongated member and positioned adjacent to said second end.

7. The device according to claim 4, further including a plurality of gripping fingers each including an arced rod having a pair of attached ends and a central portion, said attached ends each being attached to said interior surface of said peripheral wall such that a loop is defined, each of said attached ends of each of said rods being positioned along a line orientated parallel to a longitudinal axis of said elongated member, said gripping fingers each being positioned generally adjacent to said second end of said elongated member, each of said loops being non-planar and having a curve therein such that each of said loops is curved with respect to a plane that is coplanar with said longitudinal axis, each of said gripping fingers being positioned adjacent to each other, wherein said post may be removably extended between said gripping members such that said central portions abut and frictionally engage said post.

8. The device according to claim 1, further including a plurality of gripping fingers each including an arced rod having a pair of attached ends and a central portion, said attached ends each being attached to said interior surface of said peripheral wall such that a loop is defined, each of said attached ends of each of said rods being positioned along a line orientated parallel to a longitudinal axis of said elongated member, said gripping fingers each being positioned generally adjacent to said second end of said elongated member, each of said loops being non-planar and having a curve therein such that each of said loops is curved with respect to a plane that is co-planar with said longitudinal axis, each of said gripping fingers being positioned adjacent to each other, wherein said post may be removably extended between said gripping members such that said central portions abut and frictionally engage said post.

9. An earring-post covering device for removably positioning over a post of an earring before the post is extended through an earring hole in an ear, said device comprising:

an elongated member having a first end, a second end and a peripheral wall extending between said first and second ends, said first end of said elongated member having an aperture extending into said first end such that a tube is defined, said second end being closed and having a rounded outer surface;

a plurality of gripping fingers each including an arced rod having a pair of attached ends and a central portion, said attached ends each being attached to said interior surface of said peripheral wall such that a loop is defined, each of said attached ends of each of said rods being positioned along a line orientated parallel to a longitudinal axis of said elongated member, said gripping fingers each being positioned generally adjacent to said second end of said elongated member, each of said loops being non-planar and having a curve therein such that each of said loops is curved with respect to a plane that is co-planar with said longitudinal axis, each of said gripping fingers being positioned adjacent to each other; and wherein the post may be removably extended through said elongated member such that said central portions abut and frictionally engage said post.

10. The device according to claim 9, wherein said elongated member has a length from said first end to said second end less than ½ inch.

11. The device according to claim 10, wherein said elongated member has a diameter less than ¼ inch.

12. An earring-post covering device for removably positioning over a post of an earring before the post is extended through an earring hole in an ear, said device comprising:

an elongated member having a first end, a second end and a peripheral wall extending between said first and second ends, said first end of said elongated member having an aperture extending therein and toward said second end such that a tube is defined, each of said first and second ends being tapered such that each of said first and second ends has a frusto-conical shape;

a plurality of teeth being attached to an interior surface of said peripheral wall, said teeth extending from said first end and toward said second end, said teeth comprising a resiliently compressible material;

a plurality of gripping fingers each including an arced rod having a pair of attached ends and a central portion, said attached ends each being attached to said interior surface of said peripheral wall such that a loop is defined, each of said attached ends of each of said rods being positioned along a line orientated parallel to a longitudinal axis of said elongated member, said gripping fingers each being positioned generally adjacent to said second end of said elongated member, each of said loops being non-planar and having a curve therein such that each of said loops is curved with respect to a plane that is co-planar with said longitudinal axis, each of said gripping fingers being positioned adjacent to each other; and wherein the post may be removably extended through said elongated member such that said teeth grip the post and said central portions abut and frictionally engage said post.

* * * * *